United States Patent [19]

McDowell

[11] 4,357,727

[45] Nov. 9, 1982

[54] DUAL BRUSH FLOOR SWEEPER

[75] Inventor: David E. McDowell, Grand Rapids, Mich.

[73] Assignee: Bissell, Inc., Grand Rapids, Mich.

[21] Appl. No.: 212,866

[22] Filed: Dec. 4, 1980

[51] Int. Cl.[3] ..... A47L 11/32

[52] U.S. Cl. ..... 15/41 R

[58] Field of Search ..... 15/41 R, 41 A, 41 B, 15/42–46, 48, 49 C, 383, 384, 79 R, 388

[56] References Cited

U.S. PATENT DOCUMENTS

| | | | |
|---|---|---|---|
| 426,116 | 4/1890 | Drew | 15/41 R |
| 1,319,836 | 10/1919 | Boyle | 15/42 |
| 1,886,950 | 11/1932 | French | 15/41 R |
| 3,457,575 | 7/1969 | Bienek | 15/41 A |
| 3,842,459 | 10/1974 | Tsuruzawa | 15/48 |
| 4,007,508 | 2/1977 | Ooyachi | 15/42 |

FOREIGN PATENT DOCUMENTS

| | | | |
|---|---|---|---|
| 490784 | 8/1938 | United Kingdom | 15/42 |
| 1127570 | 9/1968 | United Kingdom | 15/79 R |

*Primary Examiner*—Edward L. Roberts

*Attorney, Agent, or Firm*—Andrus, Sceales, Starke & Sawall

[57] ABSTRACT

A floor sweeper has a pair of brush rollers, each sweeping into its own dust pan. Each brush roller has different debris pickup characteristics, with one brush roller tending to be more efficient in picking up large debris and the other roller tending to be more efficient in picking up smaller debris. The illustrated embodiment discloses a front brush roller of the off-center tufted type which rotates continuously toward its respective pan during reciprocal sweeper translation, with a relatively high free-wheeling rotation in one direction of sweeper translation. The rear brush roller is of the wire twist type and also rotates continuously toward its pan during reciprocal sweeper translation, but with relatively low rolling rotation in one direction of sweeper movement.

2 Claims, 6 Drawing Figures

Fig. 3
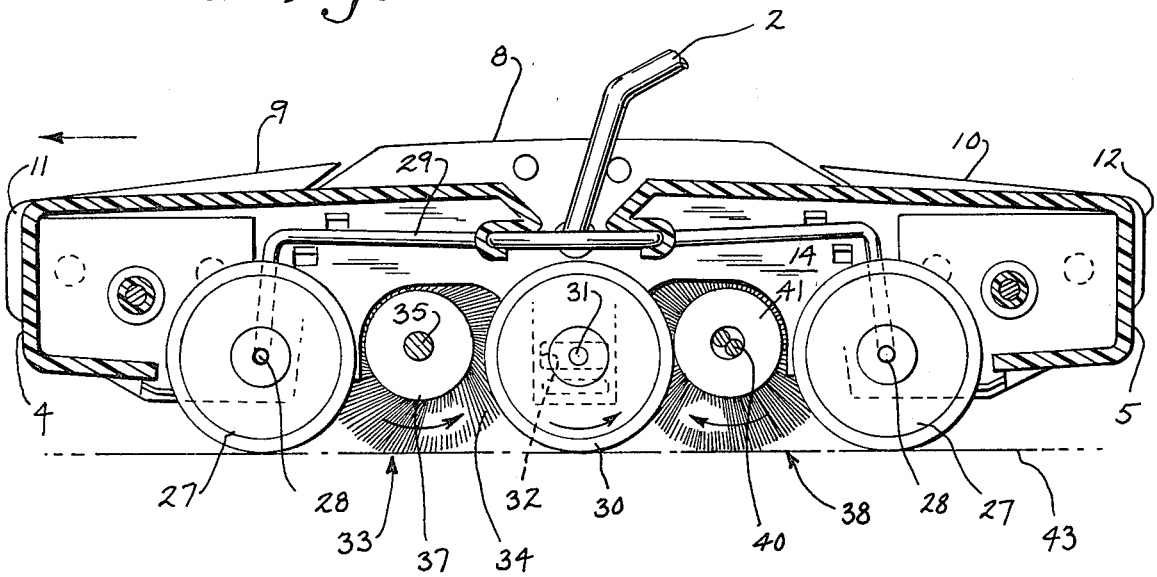
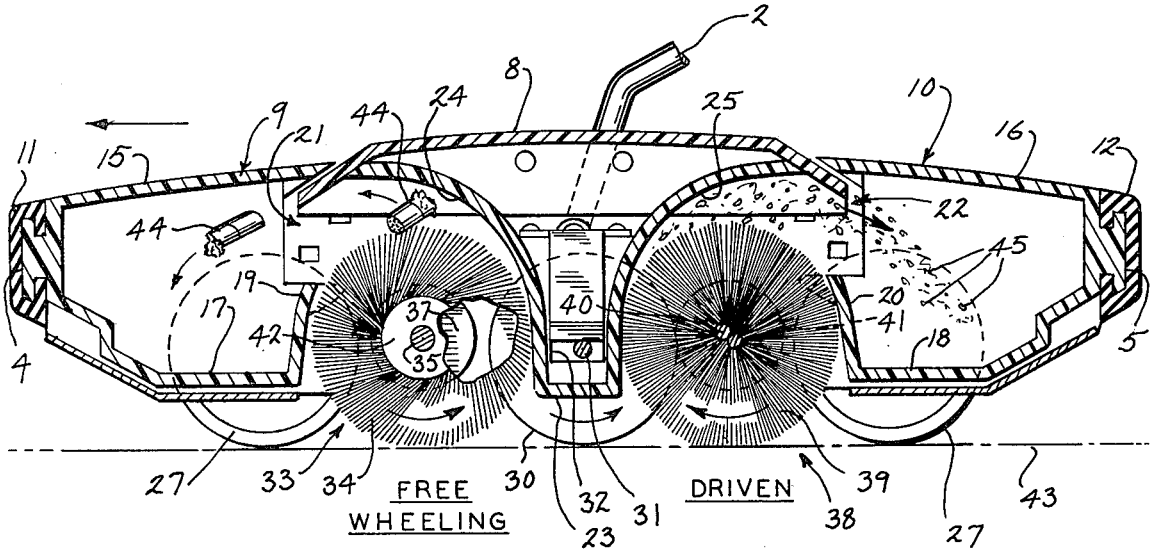
Fig. 4

Fig. 5
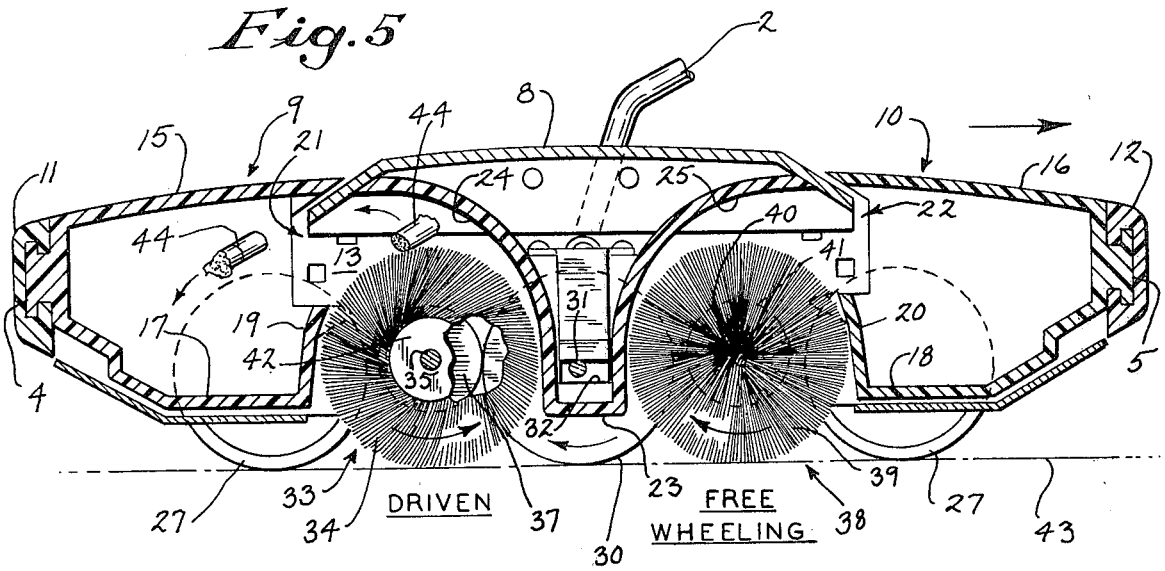
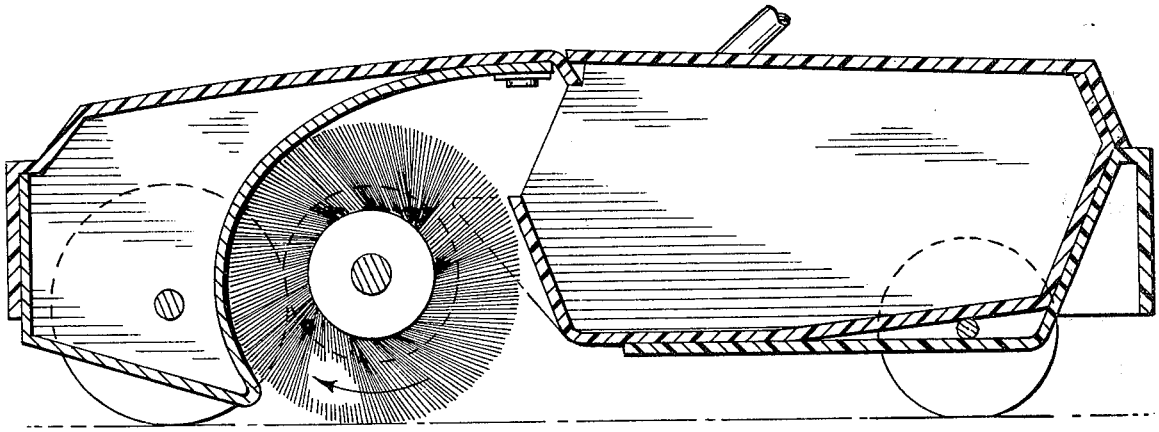
Fig. 6
(PRIOR ART)

DUAL BRUSH FLOOR SWEEPER

BACKGROUND AND SUMMARY OF THE INVENTION

This invention relates to a dual brush floor sweeper.

Floor sweepers having one or more rotatable brush rollers for sweeping debris into an adjacent dust pan have long been known. Although commonly called carpet sweepers, in recent years these devices have been developed to the point where they function very adequately on smooth floors as well as carpets. See, for example, U.S. Pat. No. 3,457,575 entitled "Sweeper For Carpeted And Smooth Floors".

It has always been desirable to provide a floor sweeper having the highest pickup efficiency possible so that a minimum of debris remains on the floor surface after several passes of the sweeper thereover. While two brush rollers are better than one in this respect, and while improvements in brush construction and drives have been made over the years, both small debris such as thread and sand, and large debris such as cigarette butts still occasionally remains behind on the floor.

It is a task of the present invention to provide an improved floor sweeper wherein the action thereof tends to increase the pickup efficiency as compared to presently known sweepers, without having to resort to the use of vacuum.

The broadest aspect of the invention is based on the discovery that a sweeper having two brush rollers, each having different pickup characteristics, tends to have an overall increased pickup efficiency as compared to a dual brush sweeper wherein the brushes have the same characteristics.

In accordance with another aspect of the invention, one of the brush rollers is of a type which tends to pick up larger size debris than the other brush roller, so that the brush rollers tend to compliment each other. One of the brush rollers may have a different type of bristle or tuft configuration than the other. Also one of the brush rollers may have a different type of rotating action than the other.

In accordance with a further aspect of the invention, the brush roller which tends to pick up larger debris may be positioned at the front of the sweeper to lessen the chance for the other brush roller to clog.

In accordance with a more detailed aspect of the invention, the front brush roller is provided with flicking type off-center bristle tufts and is adopted to rotate continuously toward its pan during both fore and aft reciprocal translation of the sweeper over the floor. The front brush roller free wheelingly rotates toward its pan at about 2½ times ordinary rolling rotation on the floor during forward sweeper movement, and is driven in the same direction during rearward sweeper movement. The rear brush roller is of the wire twist type with closely arrayed non-tufted bristles, and rotates toward its pan by freely rolling on the floor when the sweeper is moved in one direction, and is driven when the sweeper moves in the opposite direction.

BRIEF DESCRIPTION OF THE DRAWINGS

The accompanying drawings illustrate the best mode presently contemplated by the inventor for carrying out the invention.

In the drawings:

FIG. 3 is an end sectional view of the lower unit taken on line 3—3 of FIG. 2;

FIG. 4 is a central sectional view of the lower unit taken on line 4—4 of FIG. 2 during forward sweeper translation;

FIG. 5 is a view similar to FIG. 4 during rearward sweeper translation; and FIG. 6 is a sectional view of a known single brush sweeper.

DESCRIPTION OF THE PREFERRED EMBODIMENT

Figure 1:
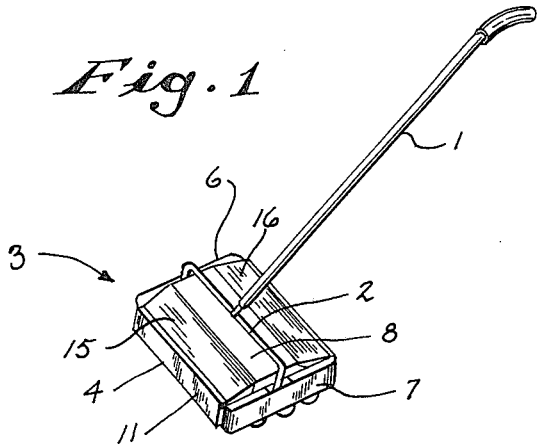
FIG. 1 is a perspective view of a floor sweeper embodying the concepts of the invention.
Figure 2:
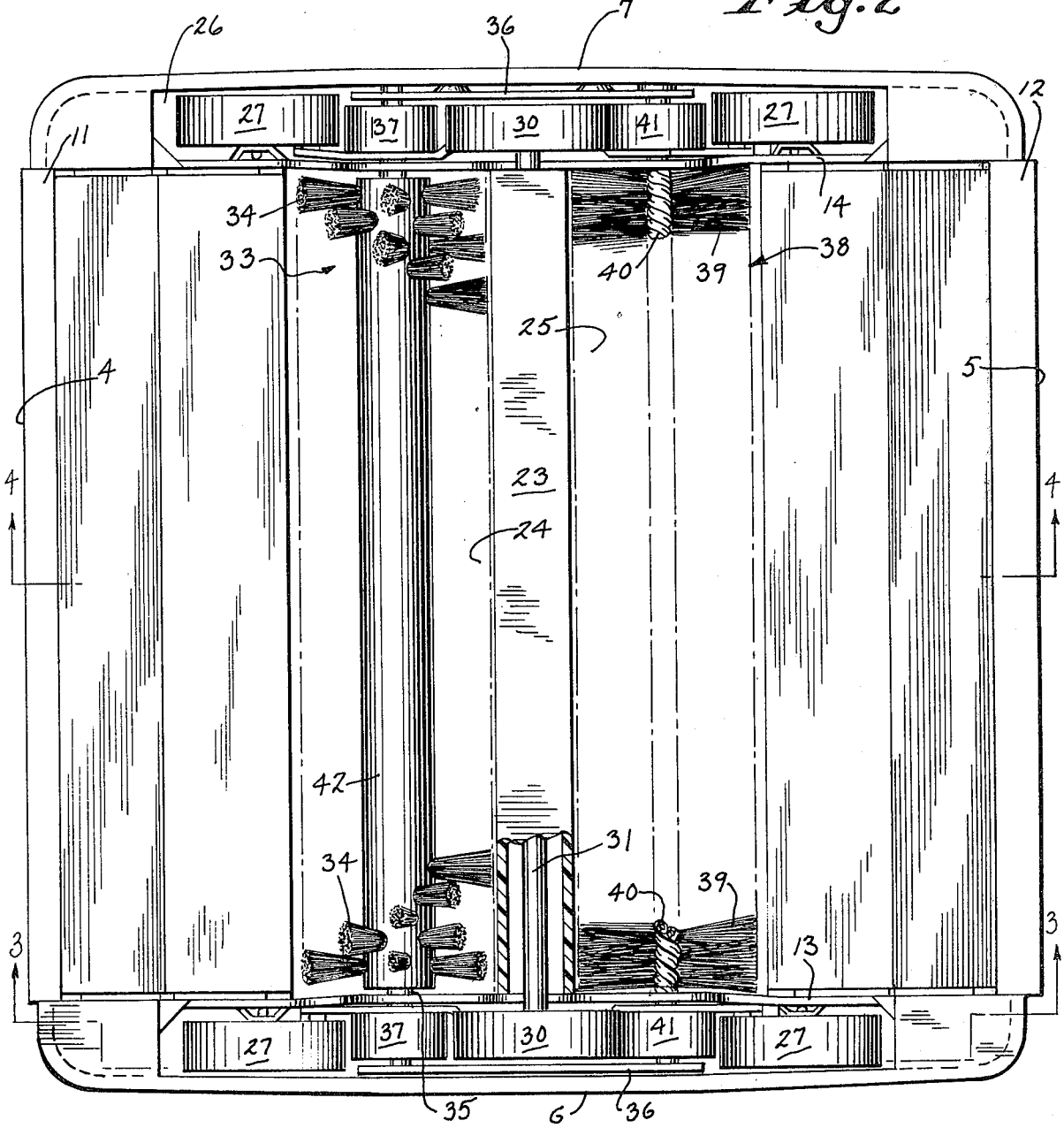
FIG. 2 is a bottom plan view of the lower unit.

As shown in the drawings, the sweeper of the invention includes the usual handle 1, bail 2 and lower sweeping unit 3. Unit 3 has a rectangular housing which includes front and rear walls 4, 5, end walls 6, 7, and a top portion 8 which extends transversely across the central portion of the top of the housing. In the present embodiment, a pair of parallel dust pans 9, 10 are provided to form two debris receiving areas. The pans are spaced longitudinally and disposed at the respective front and rear ends of the lower unit to form, together with bumpers 11, 12, the front and rear walls 4, 5. Pans 9 and 10 extend transversely between a pair of spaced longitudinally extending support plates 13, 14 and are provided with cover portions 15, 16 adapted to cooperate with housing top portion 8 to close the top of lower unit 3. Pans 9 and 10 have the usual bottom walls 17, 18 and upstanding inner walls 19, 20, with the edges of the latter cooperating with the edges of top portion 8 to form debris-receiving openings 21, 22.

A centrally disposed deflector member 23 extends transversely between support plates 13 and 14, beneath top portion 8. Member 23 includes forward and rearward facing curved deflector surfaces 24, 25.

Support plates 13 and 14 are spaced inwardly from the respective end walls 6 and 7 to form a pair of chambers 26 which receive the sweeper's support and drive mechanism. Four corner support wheels 27 are disposed in the chambers and are mounted on stub axles 28 forming the ends of springs 29 which are held in position adjacent plates 13 and 14.

A brush drive assembly is disposed centrally of lower unit 3 and comprises a pair of floor contacting drive wheels 30 joined by an axle 31, with the latter extending through deflector 23 and support plates 13 and 14. Drive wheels 30 are disposed in chambers 26 and are mounted for limited fore and aft as well as vertical movement in view of slots 32 in deflector end portions through which axle 31 extends.

A cylindrical front floor contacting brush roller 33 is disposed between front dust pan 9 and deflector 23, with roller 33 having nylon bristles 34 mounted for rotation with a central axle 35. The ends of axle 35 are journalled for rotation in supports 36 secured to end walls 6 and 7. The axle end portions carry coupling wheels 37 which are disposed in chambers 26 and adapted to be engaged by drive wheels 30, as will be described.

Similarly, a cylindrical rear floor contacting brush roller 38 is disposed between rear dust pan 10 and deflector 23, with roller 38 also having nylon bristles 39 mounted for rotation with a central axle 40. The ends of axle 40 are also journalled for rotation in supports 36. The axle end portions carry coupling wheels 41 disposed in chambers 26 which also are adapted to be engaged by drive wheels 30, as will be described.

In accordance with the broadest aspect of the invention, the overall efficiency of the floor sweeper tends to be increased by providing brush rollers 33 and 38 that have different characteristics.

For this purpose, and in the illustrated embodiment, front brush roller 33 is constructed and driven in a manner similar to that disclosed in the aforementioned U.S. Pat. No. 3,457,575. That is, it includes a relatively large core 42 in which are anchored a plurality of flexible bristles 34 in the form of tufts. The bristle tufts are mounted off center at an angle to the radial direction and angularly to the circumferential core surface. The result is that when brush roller 33 rotates in contact with a floor 43, its bristles tend to flick debris from the floor.

In addition, brush roller 33 is adapted to continuously rotate in the same direction during sweeper operation. As shown in FIG. 4, when the sweeper is moved forwardly over floor 43, drive wheels 30 are disengaged from coupling wheels 37. However, because of the type of brush construction, brush roller 33 free wheelingly rotates to flick debris up along deflector surface 24 and over its top and then through opening 21 into front dust pan 9. Its rate of free wheeling rotation has been found to be about 2½ times the rate of rotation of a brush that merely freely rolls along the floor, and thus it is still quite efficient in flinging debris into pan 9. As shown in FIG. 5, when the sweeper is moved rearwardly, drive wheels 30 move into engagement with coupling wheels 37 and positively drive the brush roller in the same direction as in forward sweeper movement.

In the illustrated embodiment, rear brush roller 38 is of the so-called wire twist type. Its axle 40 is formed of twisted wire forming a relatively small core which frictionally anchors a plurality of generally radially extending non-tufted bristles 39 which extend continuously in closely arrayed fashion along the axle. Bristles 39, although flexible, are stiffer than bristles 34 on front brush roller 33. As shown in FIG. 4, when the sweeper is moved forwardly over floor 43, drive wheels 30 are engaged with coupling wheels 41 so that brush roller 38 drivingly rotates to carry debris up along deflector surface 25 and through opening 22 into rear dust pan 10. As shown in FIG. 5, when the sweeper is moved rearwardly, drive wheels 30 move out of engagement with coupling wheels 41. In this instance, however, and because of the type of non-tufted radial brush construction, the disengaged brush roller 38 will rotate in the same direction during rear sweeper movement, but will generally merely freely roll along the floor. Its rolling rotation is thus less than half of the free wheeling rotation of brush roller 33. During mere rolling rotation, which is intermittent with the driven rotation, brush roller 38 may tend to trap debris within its bristles and carry the debris along with it toward its pan 10.

It has been observed, especially on smooth floors, that a sweeper constructed in accordance with the present embodiment tends to have an increased pickup efficiency as contrasted with one utilizing two brush rollers, both of which are of the same type, such as two brush rollers 33 or two brush rollers 38.

It is believed that when brush rollers having different pickup characteristics are used, each brush roller tends to pick up debris of a different size than the other. In the present instance, it is believed that the position, construction, drive and action of front brush roller 33 is such that it tends during a reciprocating pass of the sweeper to more efficiently pick up debris of relatively large size, such as cigarette butts 44, while the position, construction, drive and action of rear brush roller 38 is such that it tends during a reciprocating pass of the sweeper to more efficiently pick up smaller debris, such as sand and the like 45. Furthermore, the relatively closely spaced bristles 39 of rear brush roller 38 may tend to clog up if presented with substantial amounts of large debris. By placing a large debris efficient brush roller, such as 33, in front where the initial pickup action normally occurs, a buffer is created between large debris on the floor and brush roller 38. Large debris is more apt to be picked up before it is reached by rear brush roller 38. Thus, the two types of brush rollers compliment each other in the overall sweeper operation.

In the present embodiment, brush rollers 33 and 38 are disposed between dust pans 9 and 10, and therefore rotate in a direction opposite to the brush rollers of the aforementioned U.S. Pat. No. 3,457,575. By the same token, front brush roller 33 rotatably free wheels on forward sweeper movement and is driven during rearward sweeper movement, which is the reverse of the said U.S. Pat. No. 3,457,575, although it is known per se in a prior single brush sweeper shown in FIG. 6. The usual downward pressure applied to the front of the lower unit during forward sweeper movement tends to improve the action of the rotating free wheeling front brush roller 33. In the present embodiment, the overall sweeper action is further enhanced during forward movement by the driven rotation of rear brush roller 38.

While the illustrated embodiment is presently preferred, other embodiments may be constructed without departing from the spirit of the invention. For example, the bristles of both brush rollers may be made from the same or different materials, such as nylon or hog hair, and may have the same or different thicknesses. The brush rollers themselves could possibly be reversed, or of entirely different tufted or non-tufted types and with different rotary drives. Furthermore, the location of pickup of large and small debris may be either in the front or rear of the sweeper. In addition, and regardless of size, debris of greater and lesser weights may be more advantageously picked up by brushes having different pickup characteristics.

The concepts of the invention provide a floor sweeper of unique construction which tends to have improved overall pickup characteristics.

Various modes of carrying out the invention are contemplated as being within the scope of the following claims particularly pointing out and distinctly claiming the subject matter which is regarded as the invention.

I claim:

1. In a floor sweeper, the combination comprising:

(a) front and rear dust pans forming debris receiving areas, (b) front and rear rotary floor contacting brush rollers disposed between and adjacent the respective front and rear dust pans, said rollers mounted to continuously rotate in opposite directions with a floor cleaning action to sweep up and deliver debris from the floor directly to the corresponding debris receiving areas upon both fore and aft reciprocal translation of the sweeper over the floor, (c) said front brush roller comprising a core having off center bristle tufts which are arranged in spiral fashion and staggered with the bristles mounted in said core to extend outwardly therefrom at an angle to a radial direction and at an angle to the circumferential core surface, said front brush roller mounted to contact and free wheelingly rotate on the floor in a direction to deliver debris to said front dust pan upon forward translation of the sweeper over the floor, (d) said rear brush roller including a twisted wire axle having closely arrayed untufted bristles extending generally radially therefrom, said rear brush roller mounted to freely roll on the floor in a direction to deliver debris to said rear dust pan upon rearward translation of the sweeper over the floor, (e) wherein the rate of said free wheeling rotation of said front brush roller is about 2½ times the rate of said free rolling rotation of said rear brush roller, (f) and means;

(1) to drive said front brush roller in the direction of its aforementioned free wheeling rotation to deliver debris to said front dust pan upon rearward translation of the sweeper over the floor, (2) and to drive said rear brush roller in the direction of its aforementioned free rolling rotation to deliver debris to said rear dust pan upon forward translation of the sweeper over the floor.

2. The floor sweeper of claim 1 wherein said front brush roller tends to pick up larger size debris than said rear brush roller to thereby reduce clogging of said rear brush roller.

* * * * *